United States Patent [19]

Macchi

[11] 4,405,114

[45] Sep. 20, 1983

[54] JACK FOR TENSIONING CABLES IN PRESTRESSED CONCRETE STRUCTURES

[76] Inventor: Romualdo Macchi, Via S. Paolo 31, Pisa, Italy

[21] Appl. No.: 268,157

[22] Filed: May 29, 1981

[30] Foreign Application Priority Data

Jun. 12, 1980 [IT] Italy ..... 9464 A/80

[51] Int. Cl.[3] ..... E21B 19/00

[52] U.S. Cl. ..... 254/29 A; 29/452

[58] Field of Search ..... 254/29 A; 29/452; 52/225, 230

[56] References Cited

U.S. PATENT DOCUMENTS

| | | | |
|---|---|---|---|
| 3,090,598 | 5/1963 | Paul | 254/29 A |
| 3,399,865 | 9/1968 | Kelly | 254/29 A |
| 3,412,511 | 11/1968 | Dietrich | 254/29 A X |
| 3,554,492 | 12/1967 | Beghi | 254/29 A |
| 3,692,277 | 9/1972 | Schwartz et al. | 254/29 A |
| 4,048,706 | 9/1977 | Ludvigson | 254/29 A X |
| 4,106,752 | 8/1978 | Roqueta | 254/29 A |
| 4,279,068 | 7/1981 | Altmayer | 254/29 A X |

FOREIGN PATENT DOCUMENTS

| | | | |
|---|---|---|---|
| 1125176 | 8/1968 | United Kingdom | 52/230 |

*Primary Examiner*—James G. Smith
*Assistant Examiner*—Steven P. Schad
*Attorney, Agent, or Firm*—McGlew and Tuttle

[57] ABSTRACT

A jack for tensioning cables in prestressed concrete structures, is made to react on the distribution plate with one member of a cylinder-piston system, the other member engaging the strands or wires of the cable to tension them by the lengthening of such cylinder-piston system. The strands pass through the variable-volume chamber of the cylinder-piston system inside guide pipes sliding in one of the members and engaging the other.

7 Claims, 5 Drawing Figures

JACK FOR TENSIONING CABLES IN PRESTRESSED CONCRETE STRUCTURES

FIELD AND BACKGROUND OF THE INVENTION

The invention relates to jacks for tensioning stranded or wire (rods) cables contained in sheaths embodied in concrete structures which are to be prestressed with said cables. The known jacks generally provide for a cylinder-piston unit having an annular cross section to allow for a central zone not to be utilized by the hydraulic system but necessary to receive the end sections of the cables or strands protruding from the anchoring head to which the cables or strands are to be anchored after the tensioning performed by the jack. Said central zone must have its cross sectional area of the same magnitude as that of the anchoring head area or at least of the part of said head where the anchorages of the wires or strands are located. All this brings about remarkable transverse outer dimensions and a heavy weight for the jack.

SUMMARY OF THE INVENTION

The invention relates to a jack for tensioning stranded or wire cables, having the same function of the aforementioned jacks of the current art. An object of the invention is to realize a jack which allows a substantial reduction in the outer dimensions and weight with respect to known jacks of the type aforementioned, yet maintaining their other characteristics. These and further objects of the invention will be apparent to those skilled in the art upon reading the following specification.

The invention relates to a jack for tensioning sheathed cables made up of strands or wires (rods) in prestressed concrete structures—said jack being able to react on the distribution plate with a member of a cylinder-piston system while the other member engages the strands or wires to tension them by the lengthening of said cylinder-piston system—characterized by the fact that the strands or wires individually and independently pass through the variable-volume chamber of the cylinder-piston system respectively inside single or individual corresponding guide pipes sliding in one of the members and engaging the other one.

Practically, the guide pipes slidably go through the member resting on and reacting with the distribution plate, and engage the member—especially the cylinder—which moves with respect to the distribution plate and engages the strands for their tensioning.

Advantageously, the guide pipes have an inner section slightly greater than that of the strands and a limited thickness sufficient enough to resist the external uniform pressure.

Therefore, the cross section of the cavity having changeable volume is not annular, and has a size somewhat corresponding to that of the anchoring head for the cables.

BRIEF DESCRIPTION OF THE DRAWINGS

The drawing schematically shows an embodiment of the invention not to be considered in a limitative sense. In the drawing.

DESCRIPTION OF THE PREFERRED EMBODIMENTS

Figure 1:
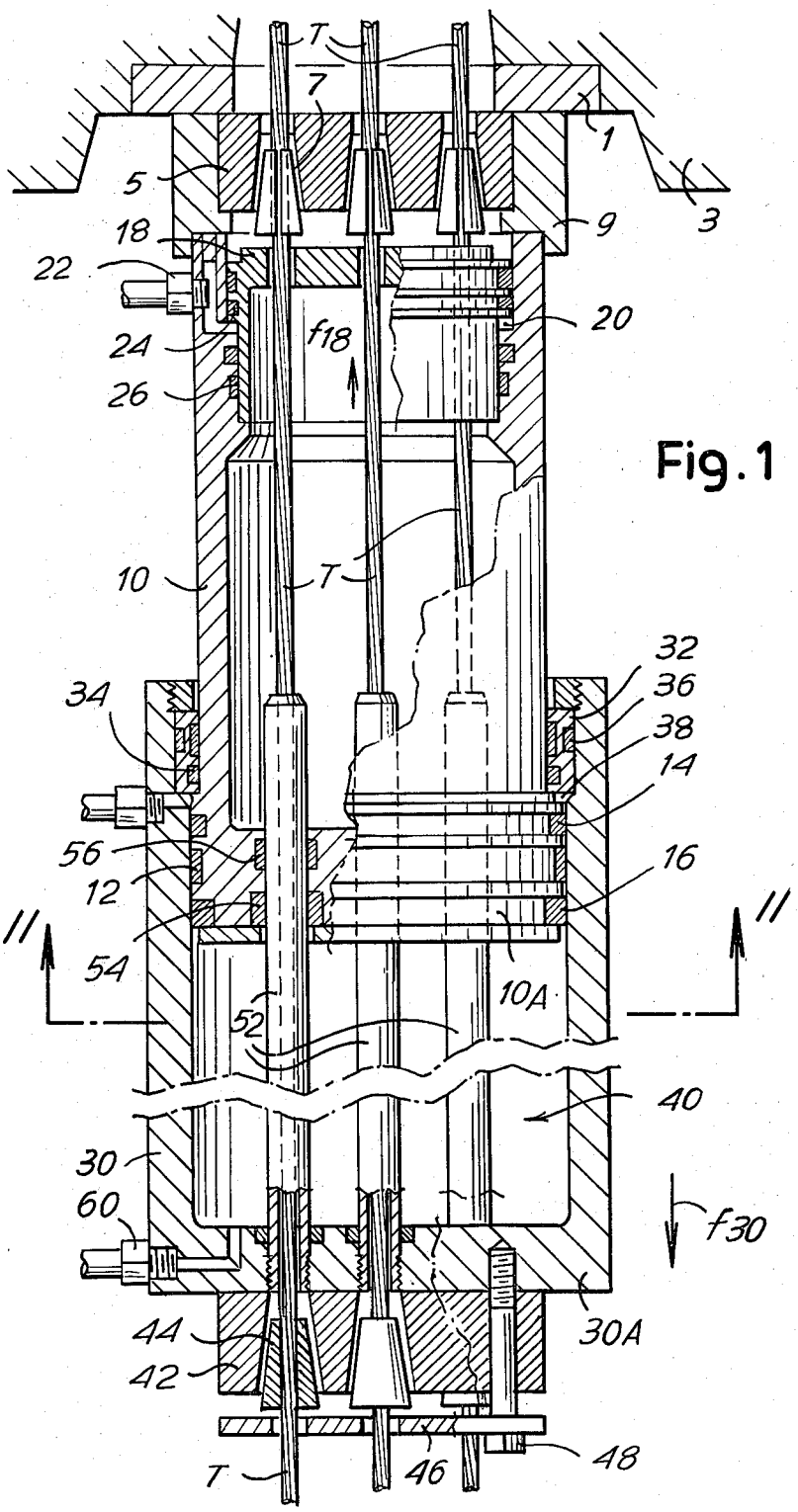
FIG. 1 shows a longitudinal view in section of a jack realized according to the invention.

With reference to the accompanying drawing, numeral 1 indicates a plate for the load distribution on the prestressed concrete structure 3 within which the sheath is incorporated containing the wires or strands T of the cable to be tensioned for prestressing. From this point onwards, "strands" will be mentioned only for the sake of convenience, this term referring to components made up of strands, rods, wires or equivalent means, i.e. linear tensioning means. Numeral 5 indicates the anchoring head or anchoring head means of selective transverse dimension or dimetric width or section to which the strands T are to be anchored. This head presents conventional frustoconical holes in a number and distribution according to the plurality of corresponding strands T; each one of the frustoconical holes of the head 5 is able to receive correspondingly anchoring wedges 7 for anchoring respectively the contemplated plurality of the strands T (or wires, rods or the like). Numeral 9 indicates a movable support for centering the jack cooperating with the head 5.

The actual jack has a hollow cylindrical component 10 acting as a piston, e.g. as an adjacent member or component of the cylinder-piston system for acting operatively against the distribution plate 1, with one end resting on the centering support 9 and the other end forming the piston head 10A with suitable annular grooves for a guide ring 12 and for annular seals 14 and 16. The component 10 forms—adjacent to its end resting on the centering support 9—a cylindrical seat having a step profile to allow a piston 18 to arrange; or provide for the arrangement of, the wedges 7 of the head 5; thus the piston 18 and component 10 define a cavity 20 connected with an oil pressure feed, and corresponding oil pressure discharge, through a pipe fitting 22. Numeral 24 indicates sealing gaskets with respect to said cavity 20, and numeral 26 indicates a guide ring. The displacement of piston 18 in the direction of the arrow f18 provides for the forcing of wedges 7 on strands T and hence, the anchorage of said strands on the head 5; a tension of strands T in the direction opposite to that of the arrow f18, provides for the release of wedges 7 and the reversal of piston 18, whose cavity 20 is arranged for the corresponding oil pressure discharge.

Numeral 30 indicates the external cylinder, e.g. as a remote member or component of the cylinder-piston system for engaging operatively the plurality of linear tensioning means or strands T which extend through the distribution plate 1 to tension such strands upon extending the jack. The cylinder 30 cooperates with the head 10A of piston 10 and hence, with seals 14 and 16 and with guide ring 12 as well. A guide ring 32 is connected to the cylinder 30, said ring 32 having a seal 34 able—together with seal 14 and a seal 36—to ensure the sealing of the variable-volume chamber 38 upon a reversal of cylinder 30 with respect to piston 10. The cylinder-piston system 10, 30 defines a variable-volume cavity 40 which is delimited by the head 10A of piston 10 and by the bottom 30A of cylinder 30. Bottom 30A is disposed at the closed end of cylinder 30 so as to form a centrally unobstructed cylinder end wall extending continuously across the cylinder thereat whereas the opposite end of cylinder 30 is open for slidably operatively receiving piston 10. In turn, head 10A is provided on piston 10A as a centrally unobstructed end face extending continuously transversely across the piston and forming a correspondingly centrally unobstructed continuous piston working surface disposed in opposed facing relation to the cylinder end wall or bottom 30A and constituting the piston working surface used for extending the jack to tension the strands T. A disk 42 is outwardly resting on bottom 30A for the anchoring of the auxiliary wedges 44 with an arrangement similar to that of head 5; a disk 46 cooperates with disk 42 for the locking of the wedges 44, said disks 46 and 42 being engaged to the bottom 30A by means of screws 48.

At the bottom 30A, corresponding individual spaced apart guide pipes 52 are positively fixed and sealed by means of a suitable gasket, which pipes are parallel to the axis of the jack unit, fined up with the respective T and able to receive them so as to let them individually and independently pass throughout the jack, from the holes of the head 5, through corresponding holes of the piston 18 and via their respective guide pipes 52 to reach the wedges 44 of disk 42; the strands pass even through the head 10A of piston 10, since the pipes 52 pass through said head 10A of piston 10, seals 54 and guide rings 56 being provided for slidably arranged cooperating between the single pipes 52 and the head 10A of piston 10; the strands T, therefore, individually and independently pass through head 10A of piston 10 respectively inside the single or individual corresponding pipes 52. The pipes 52 extend correspondingly through the cylinder end wall or bottom 30A, the variable volume cavity or chamber 40, and the piston end face or head 10A, in any position of relative movement of the piston 10 and cylinder 30.

Figure 2:
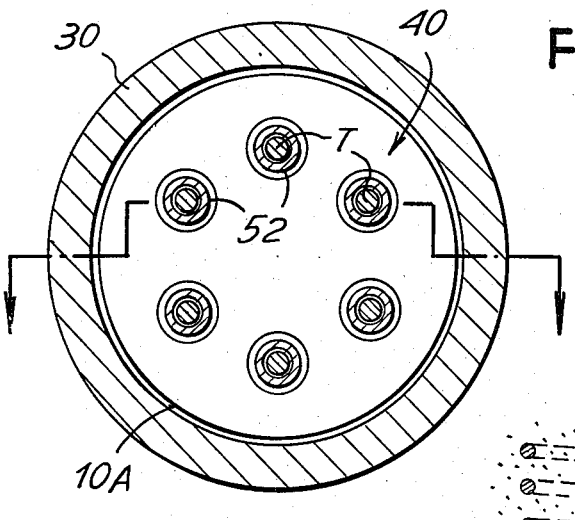
FIG. 2 is a schematic view in cross section on line II—II of FIG. 1.

Referring to the section of FIG. 2, it can be seen that the variable-volume cavity 40 whose cross section is useful for the tensioning of the strands, and which is a continuous and centrally unobstructed cross section, corresponds, practically, to the section of head 5, taking away the sum of the relatively very small cross-sections of pipes 52, the latter being formed with and inner cavity just sufficient for the receipt of the respective strand T and with a limited thickness of the cylindrical wall sufficient enough to withstand the uniform external pressure to which the single pipes are subjected in any position of movement of the cylinder 30 and piston 10 during the jack tensioning performance, i.e. the oil pressure externally exerted on the guide pipes 52 within the variable-volume cavity 40 (see FIG. 1). The transverse dimension or diametric width of the cavity 40 likewise corresponds to that of the head 5. It follows, then, that the jack dimensions are quite smaller than those of the jacks in which the useful cavity (corresponding to the one indicated by 40) has an annular cross section to provide a necessary single or common, e.g. central, passage for all the strands together collectively passing through the anchoring head. The minor dimensions of the jack in question entails a correspondingly minor weight for the same, due also to a smaller thickness and diameter as well of the walls supporting the oil pressure therein.

Figure 3A:
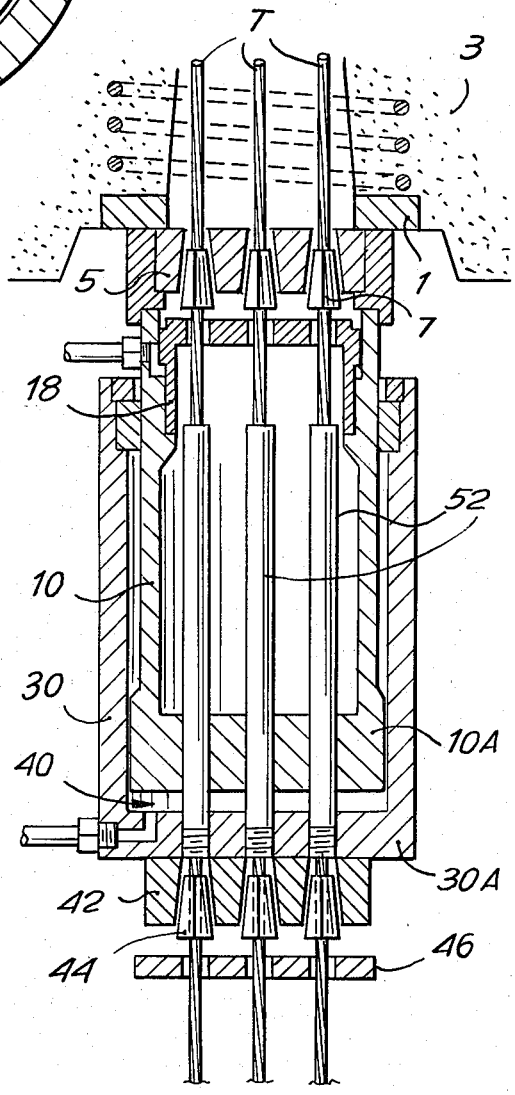
FIGS. 3A, 3B and 3C show various stages of a tensioning procedure performed by the jack of FIG. 1.
Figure 3B:
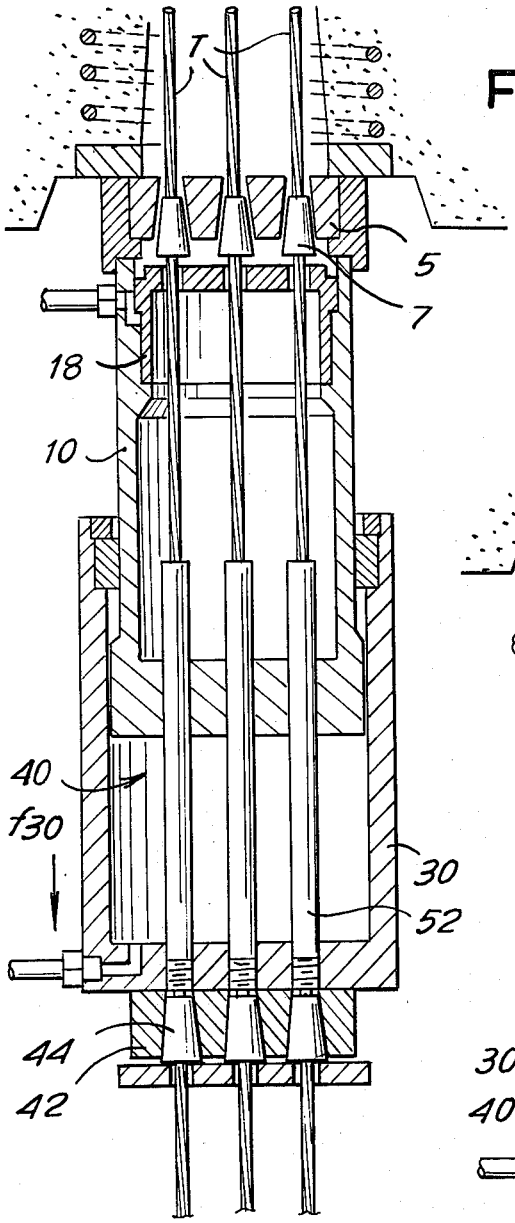
Figure 3C:
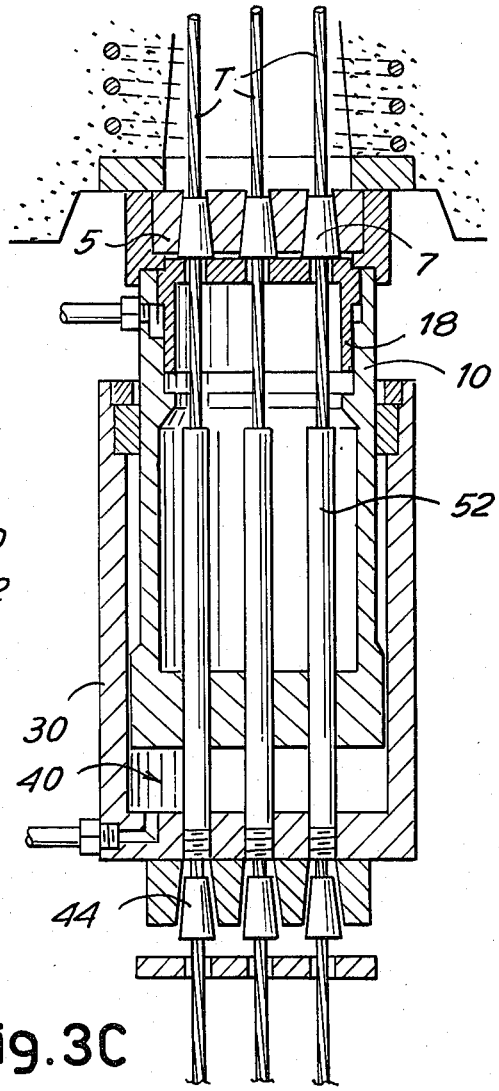

The operation of the jack of the invention is analogous to the one of the traditional jacks above mentioned. In a position of the cylinder 30 with its bottom close to piston 10 (FIG. 3A), the anchoring of the strands or cables to the disk 42 is performed by means of the wedges 44 while the cavity 20 is discharging, i.e. under oil pressure discharge, then the wedges 7 are unlocked or in condition of being unlocked by the head 5. By feeding oil under pressure to the cavity 40, for example through a pipe fitting 60, there is a slide of cylinder 30-32 relative to piston 10 and in turn a slide of pipes 52 relative to said piston as well, and hence, the lengthening of the strands is effected (FIG. 3B). As soon as the desired elongation of the strands is obtained, or at the end of the active stroke of cylinder 30 in the direction according to the arrow f30, the cavity 20 is fed with fluid under pressure for thus determining the arrangement and hence the forcing of wedges 7 into the conical holes of the head 5 (FIG. 3C), and after that, it is possible—if necessary—to repeat the tensioning operation by unlocking the wedges 44 and to return the cylinder 30 in the direction opposite to arrow f30 so that the cylinder bottom 30A reapproaches the piston head 10A by feeding fluid under pressure once more to the chamber 38, and locking again the wedges 44 for another working stroke of the jack. Thus, chamber 38 serves as a counterpart variable volume chamber to chamber 40, being formed as well by cylinder 30 and piston 10, in this case with piston 10 providing a counterpart piston working surface operatively disposed in the chamber 38 and constituting the piston working surface used for retracting the jack (see FIG. 3C). After one or more strokes of the jack and after the arrangement and final forcing of wedges 7 for the anchoring of strands T to the head 5, the jack can be moved away.

The drawing shows only an embodiment of the invention which can be varied as regards shape and dispositions.

For example, the jack may be fitted for tensioning strands or wires to be anchored on a thin distribution plate supplied with single cylindrical anchoring elements having a conical seat correspondingly for wedges 7 and an even, i.e. correspondingly, number of wires or strands. In this case, the component 10 is made solid instead of having a tubular section, and crossed by holes corresponding to the various cylindrical anchoring elements, on which the reaction of the jack is released, i.e. is applied. Into each of these holes, then, one of the sheaths 52 extends, and a single corresponding wedging means is received having the form of a small piston to function like piston 18 but individually for the wedges of every single strand or wire.

I claim:

1. Jack for tensioning a plurality of individual linear tensioning means in the form of individual cables made up of sheathed strands, wires, rods or the like, for prestressing concrete structures containing such linear tensioning means and which linear tensioning means individually extend outwardly from the corresponding concrete structure through a distribution plate for anchoring to anchoring head means thereat, comprising a cylinder-piston system including a cylinder member and a piston member, such two members forming a variable volume chamber therebetween and being arranged for relative slidable movement toward and away from each other to extend and retract the jack, one of the members being arranged as an adjacent member for acting operatively against such distribution plate and the other of the members being arranged as a remote member for engaging operatively such plurality of linear tensioning means which extend outwardly through the distribution plate to tension the linear tensioning means upon relative movement of the members away from each other to extend the jack, the cylinder member having a closed end provided with a centrally unobstructed cylinder end wall extending continuously thereacross and an open end for slidably operatively receiving the piston member, and the piston member having a centrally unobstructed end face extending continuously thereacross and forming a corresponding centrally unobstructed continuous piston working surface disposed in opposed facing relation to the cylinder end wall and being relatively movable toward and away from the cylinder end wall to vary the volume of the chamber between the members as the members move relatively toward and away from each other to retract and extend the jack and constituting the piston working surface used for extending the jack to tension the linear tensioning means, and a plurality of individual guide pipes arranged in spaced apart relation and individually operatively extending correspondingly through the cylinder end wall, the chamber and the piston end face in any position of relative movement of the members and being operatively mounted on one of the members and slidably arranged relative to the other member, for operatively individually receiving a corresponding linear tensioning means therethrough from the distribution plate for operative engagement with the remote member.

2. Jack of claim 1, wherein the remote member is the cylinder member and the guide pipes are mounted thereon and slidably arranged relative to the piston member.

3. Jack of claim 1, wherein the guide pipes are arranged with such linear tensioning means individually operatively received therein, and such guide pipes have an inner diameter slightly greater than the diameter of the individual corresponding linear tensioning means received therein.

4. Jack of claim 1, wherein the guide pipes have a corresponding pipe wall thickness just sufficient to withstand the external uniform pressure in the chamber in any position of movement of the members.

5. Jack of claim 1, wherein the chamber has a continuous and centrally unobstructed cross section.

6. Jack of claim 1, wherein the adjacent member is arranged operatively against such distribution plate and the distribution plate is provided with such anchoring head means thereat, the anchoring head means having a selective transverse dimension, and the chamber has a continuous and centrally unobstructed cross section and a transverse dimension corresponding to that of the anchoring head means.

7. Jack of claim 1, wherein the two members also form a counterpart variable volume chamber and the piston member is provided with a counterpart piston working surface operatively disposed in the counterpart chamber and constituting the piston working surface used for retracting the jack.

* * * * *